United States Patent [19]

Bugajski et al.

[11] 4,165,260

[45] Aug. 21, 1979

[54] PIPELINE CHARGING OF COAL INTO COKE OVEN

[75] Inventors: Frank H. Bugajski, South Holland, Ill.; Jitendra G. Patel, Munster, Ind.

[73] Assignee: Inland Steel Company, Chicago, Ill.

[21] Appl. No.: 755,498

[22] Filed: Dec. 29, 1976

[51] Int. Cl.[2] ..... C10B 31/04

[52] U.S. Cl. ..... 201/40; 202/262; 406/154

[58] Field of Search ..... 201/40; 202/262, 270; 302/28, 59; 214/18 R, 35 R

[56] References Cited

U.S. PATENT DOCUMENTS

| | | | |
|---|---|---|---|
| 3,047,473 | 7/1962 | Schmidt | 201/4 |
| 3,432,398 | 3/1969 | Schmidt | 201/40 |
| 3,457,141 | 7/1969 | Schmidt | 201/40 |
| 3,753,867 | 8/1973 | Wiemer | 201/40 X |
| 3,761,360 | 9/1973 | Auvil | 201/40 |

*Primary Examiner*—Michael S. Marcus

*Attorney, Agent, or Firm*—Merriam, Marshall & Bicknell

[57] ABSTRACT

Coal mixed with steam is carried through a pipeline to a coke oven where the mixture is introduced through an opening in the oven top directly downwardly into the oven at a location remote from the exhaust outlet in the top of the coke oven.

8 Claims, 3 Drawing Figures

PIPELINE CHARGING OF COAL INTO COKE OVEN

BACKGROUND OF THE INVENTION

The present invention relates generally to a method for charging coal into a coke oven through a pipeline and more particularly to a method for doing so in such a manner as to minimize the amount of coal fines which are removed from the coke oven through an exhaust conduit during the charging operation.

Typically, a coke oven has two opposite ends, both provided with doors. One end is a pusher end through which a ram or pusher is introduced for pushing coke toward the opposite, discharge end, also called the coke side.

Methods and apparatus for charging coal into a coke oven through a pipeline are disclosed in Auvil U.S. Pat. No. 3,761,360, which discloses pipeline charging through the end wall of the coke oven, and in Schmidt U.S. Pat. No. 3,047,473 which discloses pipeline charging through the top of the coke oven.

Generally, in the pipeline charging of coke ovens as disclosed in Auvil U.S. Pat. No. 3,761,360, coal is entrained with a carrier gas such as steam and conducted through a main pipeline extending alongside a battery of coke ovens. A branch pipeline extends from the main pipeline to the pusher end of each coke oven and directs the mixture of coal and steam into the coke oven through an entry in the pusher end near the top thereof. Near the opposite end of the coke oven, in the roof thereof, is an exhaust opening, and, during the charging operation, there is an unavoidable discharge of coal fines through the exhaust opening. This is commonly referred to as fines carryover. Fines carryover is undesirable, and is a problem which must be minimized.

The problem of fines carryover is especially prevalent at the beginning and end of the charging operation.

More specifically, the temperature of the coke oven is substantially higher than the temperature of the coal particles entering the oven during charging, and the increased temperature in the coke oven causes volatilization of the coal particles. The volatile gases given off from the coal, as well as the carrier gas utilized to conduct the coal to the coke oven through the pipeline, are exhausted from the coke oven through the exhaust opening at the end of the coke oven. The greater the amount of gases in the coke oven, the greater the pressure in the coke oven and the greater the exhaust effect. It is believed that the greater the exhaust effect, the greater the amount of fines carryover. Volatilization of the coal particles and the amount of gas resulting therefrom is greatest at the beginning of the charging operation.

In the prior art end-charging method, one attempt to overcome the problem of fines carryover was to vent some of the carrier gas from the mixture of coal and carrier gas, just prior to entry of the mixture into the coke oven, thereby reducing the amount of gases in the coke oven.

There is a zone adjacent the exhaust outlet where the exhaust effect is so great that any particle entering that zone will be blown or forced out of the coke oven. The fines carryover problem at the beginning of the charging operation and, to some extent, throughout the charging operation, is aggravated when coal particles are directed or rebound toward that exhaust zone.

The problem of increased fines carryover near the end of the charging operation arises from the following considerations. There is a moving gas stream within the coke oven normally proceeding from the entry end of the coke oven to the exhaust outlet. As the level of the coal bed in the coke oven rises, the velocity of the gas stream moving from the entry end of the coke oven to the exhaust end of the coke oven increases. This is because the cross sectional area of the oven through which the gas can flow decreases as the coal bed rises in the oven, thereby increasing the velocity of the gas stream which is being exhausted from the coke oven. The increased velocity of the gas stream moving toward the exhaust outlet tends to carry with it newly introduced coal particles from the mixture of coal and carrier gas, exhausting these particles before the particles have a chance to settle out from the mixture onto the bed of coal.

SUMMARY OF THE INVENTION

A pipeline charging method in accordance with the present invention reduces fines carryover during the entirety of the charging operation while reducing the pressure within the coke oven during the charging operation and increasing the amount of coal which can be accommodated within a coke oven for a given charging operation.

The coal is introduced into the heated coke oven by directing the coal-steam mixture directly downwardly into the oven through the top of the oven at a predetermined charging location on the oven top which is closer to the pusher end of the coke oven than to the discharge end near which the exhaust outlet is located. At the beginning and throughout the charging operation fines carryover is decreased because the vertically descending coal particles are not being directed or rebounded toward the exhaust outlet, in contrast to methods involving end charging.

Preferably, the coal is directed straight downwardly, and it accumulates initially in a relatively localized pile directly below the charging opening. As a result there is less volatilization of the coal during the charging operation than would be the case if the coal were more uniformly distributed over the entire bottom of the coke oven at the beginning of the charging operation, as with end charging. In addition, there is a decreased amount of gas to be exhausted during the charging operation, resulting in decreased fines carryover. There is also a decreased pressure within the coke oven during charging, both average pressure and peak pressure. Because there is less gas volatilized within the coke oven during charging, and because there is decreased gas pressure during charging, it is unnecessary to vent steam from the coal-steam mixture prior to entry of the mixture into the coke oven.

As more coal is introduced into the coke oven, the bed of coal rises in the oven, and the bed is essentially level along the length of the coke oven. Near the conclusion of the charging operation, the bed level is relatively high, and there is an increase in the velocity of the gas stream moving across the top of the coal bed toward the exhaust outlet. However, because the coal is introduced downwardly into the coke oven and at a location spaced substantially the maximum practical distance from the exhaust outlet, any coal particles which are caught up in the exhaust stream have the maximum possible chance to settle out from the gas stream as the latter moves toward the exhaust outlet. In addition the coal particles, upon introduction, do not have imparted to them a directional component corresponding to the direction of movement of the gas stream moving toward the exhaust outlet, as in methods utilizing end charging.

A method in accordance with the present invention, produces a more compact, dense coal bed in the coke oven, thereby increasing the amount (weight) of coal per charge without increasing the volume occupied by the coal in the coke oven.

Other features and advantages are inherent in the method claimed and disclosed or will become apparent to those skilled in the art from the following detailed description in conjunction with the accompanying diagrammatic drawing.

DETAILED DESCRIPTION

Figure 1:
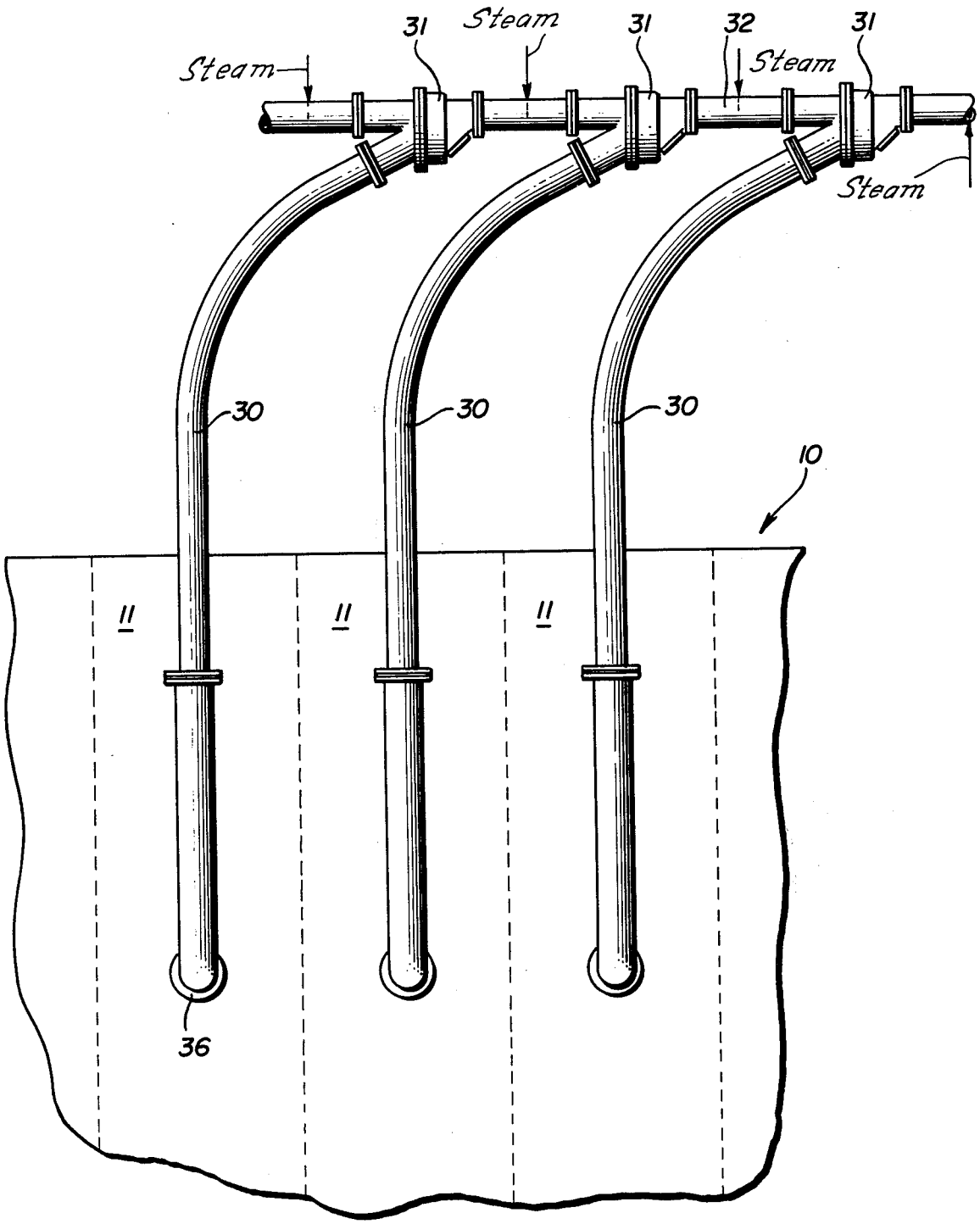
FIG. 1 is a plan view illustrating a battery of coke ovens into which coal is charged in accordance with an embodiment of the present invention.

Referring to the figures, there is disclosed generally a battery 10 of coke ovens 11 each having a floor or bottom 12, a roof or top 13, a pusher end 14 having a door 15 and a discharge end 16 opposite pusher end 14 and having a discharge door 17. Each coke oven 11 also includes side walls 18. Located in coke oven top 13 is a top-charging opening 20 adjacent pusher end 14, and located in coke oven top 13 adjacent discharge end 16 is an exhaust outlet 21.

Also located in coke oven top 13 are a plurality of other openings. Openings 22 and 24 are traditionally provided in coke ovens but are not necessary in a coke oven top-charged in accordance with the present invention. Accordingly, openings 22, 24 are shown sealed by caps 23, 26 respectively. A pressure relief hole 27 in coke oven top 13 is closed by a lid 28 which is free to rise when the pressure within the oven exceeds a predetermined amount (e.g., 0.5 psig).

Communicating with exhaust outlet 21 is an exhaust conduit 25 for removing exhaust fumes and gases from within coke oven 11.

Communicating with top-charging opening 20 is a branch pipeline 30 extending from a diverter valve 31 on a main pipeline 32. Branch pipeline 30 comprises a slightly sloping first part 33, a second part 34 curving downwardly from first part 33 and a third part 35 depending vertically from second part 34 and having an axis substantially tangential to the axis of second part 34.

First part 33 of branch pipeline 30 should slope slightly downwardly toward coke oven top 13 sufficiently to prevent an accumulation of condensables (primarily water) in first part 33 and to drain the condensables into the coke oven. If condensables were permitted to accumulate in first part 33, the condensables would form a sludge with the coal particles passing through part 33 during the charging operation and cause plugging problems in branch line 30. Because first part 33 slopes downwardly toward coke oven top 13, it also prevents any sludge which may possibly form in branch line 30 from falling back into main pipeline 32 where the sludge could cause other problems such as plugging the steam jets normally provided inside main pipeline 32.

Branch part 34 may have a larger diameter (e.g., 8") than branch part 33 (e.g., 6") or than line 32 (e.g., 6") to lower the gas velocity in part 34 just prior to entry of the coal-steam mixture into the coke oven.

Branch pipeline 30 terminates at an end 37 located in a diverging lower portion 38 of coke oven top opening 20. Opening 20 is sealed by a cap 36 through which branch pipeline 30 extends. The distance between opening 20 and pusher end 14 is less than 25% of the total distance from pusher end 14 to discharge end 16.

Coal is charged into coke oven 11 when the coke oven is at a temperature above that at which the coal volatilizes. First, however, the coal is mixed with steam in a bin (not shown) and introduced into main pipeline 32 which constitutes an enclosed path for conducting the coal-steam mixture into each of the coke ovens 11 in battery 10. Steam is also injected at spaced intervals along pipeline 32 to convey the coal. Main pipeline 32 runs alongside the pusher end 14 of each coke oven 11, and the main pipeline is provided with a plurality of diverter valves 31 from each of which extends a branch line 30 leading to each of coke ovens 11.

When a given coke oven 11 in battery 10 is to be charged, the diverter valve 31 corresponding to that coke oven is actuated to close main pipeline 32 downstream of that particular diverter valve and open branch line 30 for that particular coke oven. The mixture of coal and steam is thus diverted from the main pipeline into the branch line 30 which conducts the coal-steam mixture first along sloping path part 33 and then along downwardly curving path part 34 and then along vertically depending path part 35 through branch line end 37 into coke oven 11.

The coal-steam mixture is introduced straight down into the coke oven without substantially horizontal component to its direction. The direction of introduction may deviate slightly from straight down, but, the greater the deviation from straight down, in a horizontal direction toward exhaust outlet 21, the greater the fines carryover. The important consideration is to introduce the coal-steam mixture into the coke oven without imparting to the coal a substantial directional component corresponding to the direction of movement of the gas stream moving toward exhaust outlet 21.

No steam is vented from the coal-steam mixture while it is being conducted through the branch line 30, or at any time between main pipeline 32 and coke oven 11. During the coking operation, after charging, steam is introduced through a steam line 50 into branch part 35 to cool branch part 35 at end 37 which is exposed to the high temperatures prevailing within the coke oven, the steam being substantially cooler than the temperature inside the coke oven (2000°–2300° F.). To prevent line 50 from clogging with coal fines during the charging operation, the introduction of steam at 50 is continued during charging.

The temperature within the coke oven is well above that at which the coal volatilizes. Gases driven off from the coal during volatilization, as well as the steam mixed with the coal at the time it was introduced into the coke oven, are exhausted through exhaust outlet 21. During the charging operation there is a moving gas stream within the coke oven in the direction of end wall 16 and exhaust outlet 21. Adjacent exhaust outlet 21 is a zone indicated schematically by dotted lines at 40, within which the exhaust effect is so great that almost any coal particle entering that zone is unavoidably exhausted from coke oven 11. The closer the particle comes to exhaust zone 40 the greater the exhaust effect. The greater the velocity of the moving gas stream in coke oven 11 directed toward end wall 16 and exhaust outlet 21, the greater the likelihood that particles remote from zone 40 will be carried by the moving gas stream into exhaust zone 40 from which the particles would be exhausted from the coke oven.

A method in accordance with the present invention employs features which prevent or minimize coal particles from being drawn toward or directed to exhaust zone 40. Thus, the carryover of coal particles from the coke oven is minimized by directing the coal particles into the coke oven in a downward direction at a location as far removed as practical from exhaust zone 40. If the coal particles were directed into the coke oven through pusher end wall 14 with a direction component toward exhaust zone 40, or if the particles were directed into the coke oven at the beginning of the charge so that they rebounded off coke oven floor 12 toward exhaust zone 40, the amount of coal particles exhausted from the coke oven would increase.

Also, because the particles are directed straight downwardly into the oven, there is an initial tendency for the particles to form a relatively compact, localized pile from which the volatilization of gases is much less than if the particles were distributed across the length of the coke oven when they were initially introduced into the coke oven, as with end charging.

Because a charge of coal particles introduced into a coke oven in accordance with the present invention is more compact or dense than a bed of coal particles introduced with end charging, about 5–10% greater weight of coal can be introduced into the coke oven than with end charging, for example.

Although there is an initial tendency for the coal particles, top charged in accordance with the present invention, to form a relatively compact, localized pile, at the beginning of the charging operation, the coal bed eventually formed during the charging operation is essentially self-leveling.

Normally, during any charging operation, whether top charged or end charged, there is an increase in pressure during the charging operation, with the pressure peaking at some time during the charging operation and then dropping. When a coke oven is top charged in accordance with the present invention, both the average pressure and peak pressure during charging are less than when the coke oven is end charged. Decreasing both the average pressure and the peak pressure has a positive effect on the coke oven's structural integrity and also reduces the exhaust gas velocity, thereby reducing the likelihood of coal particles being withdrawn from the coke oven. The reduced gas pressure also results in reduced gas leakage through the oven doors, thereby reducing air pollution.

In accordance with the present invention, the coke oven is charged with the coal-steam mixture until the top of the coal bed in the oven is below the top 41 of the oven's interior, on the average, about 5–15% of the oven's interior height. When the coal bed approaches that level, the velocity of the gas stream moving toward exhaust outlet 21 is relatively high. Because, in accordance with the present invention, the coal particles are introduced into the coke oven at a location spaced the maximum practical distance from exhaust outlet 21, the chances are maximized for a coal particle suspended in the gas stream to settle out. This is because the farther from exhaust outlet 21, the greater the chances the coal particles have to settle out, even if they are caught up in the gas stream moving toward outlet 21.

In a coke oven charged in accordance with the present invention, there is a reduction in volatilization of the coal, of the gas pressure within the coke oven and of the velocity of the gas stream directed toward the exhaust outlet. Therefore, it is unnecessary to vent from the branch pipeline, prior to entry of the coal into the coke oven, steam or other carrier gas mixed with the coal. This is desirable because the venting of carrier gas from the coal-steam mixture, prior to entry into the coke oven, causes problems. If the steam is vented directly into the air, there is a pollution problem because some coal fines are unavoidably carried off with the vented steam. If the steam is not vented directly into the air, to avoid other pollution problems, the coal fines must be separated from the steam, thereby causing increased expense. All problems associated with the venting of the steam are eliminated by charging the coke oven in accordance with the present invention.

As previously indicated, the charging operation is continued until the level of the coal bed is, on the average, about 5–15% below the top of the coke oven's interior. If the level of the coal bed is too low (more than 15% below the top of the oven's interior) the production capability of the coke oven is not being effectively utilized.

If the average level of the coal bed is too high (less than 5% below the top of the oven's interior), there is a problem with overcharging in that, the coal is liable to pile up too high in localized areas and come out of the oven through the pressure relief hole 27 and lid 28.

A typical example of the dimensions of a coke oven employed in accordance with the present invention is described below.

| | | |
|---|---|---|
| Interior length, ft. | 49.17 | |
| Interior height, ft. | 20.0 | |
| Distance from pusher end to: | | |
| | ft. | % of interior length |
| charging opening 20 | 7.82 | 17.6 |
| top opening 27 | 18.49 | 39.3 |
| top opening 24 | 31.42 | 65.6 |
| top opening 22 | 40.52 | 84.1 |
| exhaust outlet 21 | 46.81 | 96.9 |
| Average distance between top of coal bed and coke oven roof at conclusion of charging operation | 1.5–2.0 ft. | (7.5–10.0% of interior height) |

A typical example of specific operating conditions employed in accordance with the present invention is described below.

| |
|---|
| Charge weight: 55,500 lb. |
| Steam rate: 3000 lb./hr. for 2.1 min. |
| 1600 lb./hr. rest of charge (7 min.) |
| Average charging rate: 6100 lb./min. |
| Average conveying line pressure: 16.0 psig |
| Average oven pressure during charging: 1.5 oz./in.$^2$ |
| Peak oven pressure during charging: 2.9 oz./in.$^2$ |
| Charging time: 9.1 min. |
| Net carryover: 101 lb. |

Size of coal charged into oven (estimated)

| U.S. SCREEN | PERCENT ON SCREEN | CUMULATIVE PERCENT |
|---|---|---|
| ¼ in. | 9.5 | 9.5 |
| 6 | 14.2 | 23.7 |
| 10 | 21.4 | 45.1 |
| 20 | 20.2 | 65.3 |
| 30 | 8.8 | 74.1 |
| 40 | 7.6 | 81.7 |
| 50 | 5.6 | 87.3 |
| 70 | 4.4 | 91.7 |
| 100 | 3.5 | 95.2 |
| 200 | 3.1 | 98.3 |
| 325 | 1.2 | 99.5 |
| −325 | 0.5 | 100.0 |

Following is a comparison of typical results obtained using end charging, as in the prior art, with typical results obtained using top charging in accordance with the present invention.

| | End Charging | top Charging |
|---|---|---|
| Number of Charges Compared | 31 | 19 |
| Average Oven Pressure, during charging, oz./in.$^2$ | 2.62 | 1.78 |
| Peak Oven Pressure, during charging, oz./in.$^2$ | 7.3 | 4.6 |
| Average Pressure Drop between oven and exhaust conduit oz./in.$^2$ | 2.28 | 1.44 |

Typically, by converting from end charging to top charging in accordance with the present invention, the amount of coal which can be charged into the coke oven, while maintaining the desired coal bed height, is increased from about 51,000 lbs. to 55,500 lbs. per charge, an increase of about 9%. In addition, the amount of fines carryover is reduced from about 1,000 lbs., for a typical end charging operation, to about 100 lbs. for a typical top charging operation in accordance with the present invention.

Figure 2:
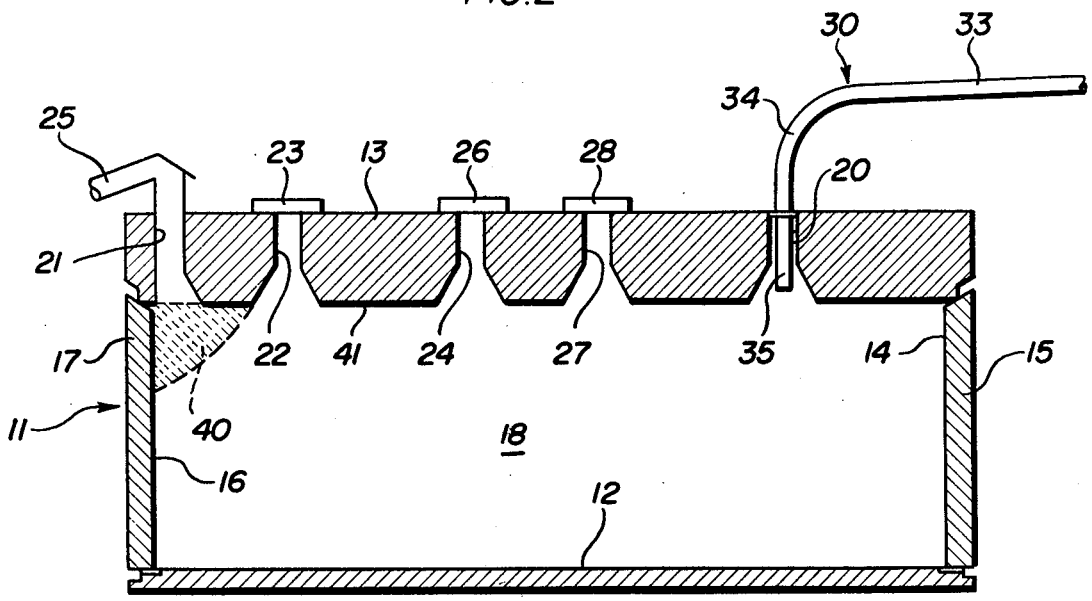
FIG. 2 is a vertical sectional view of a coke oven into which coal is charged in accordance with the present invention.
Figure 3:
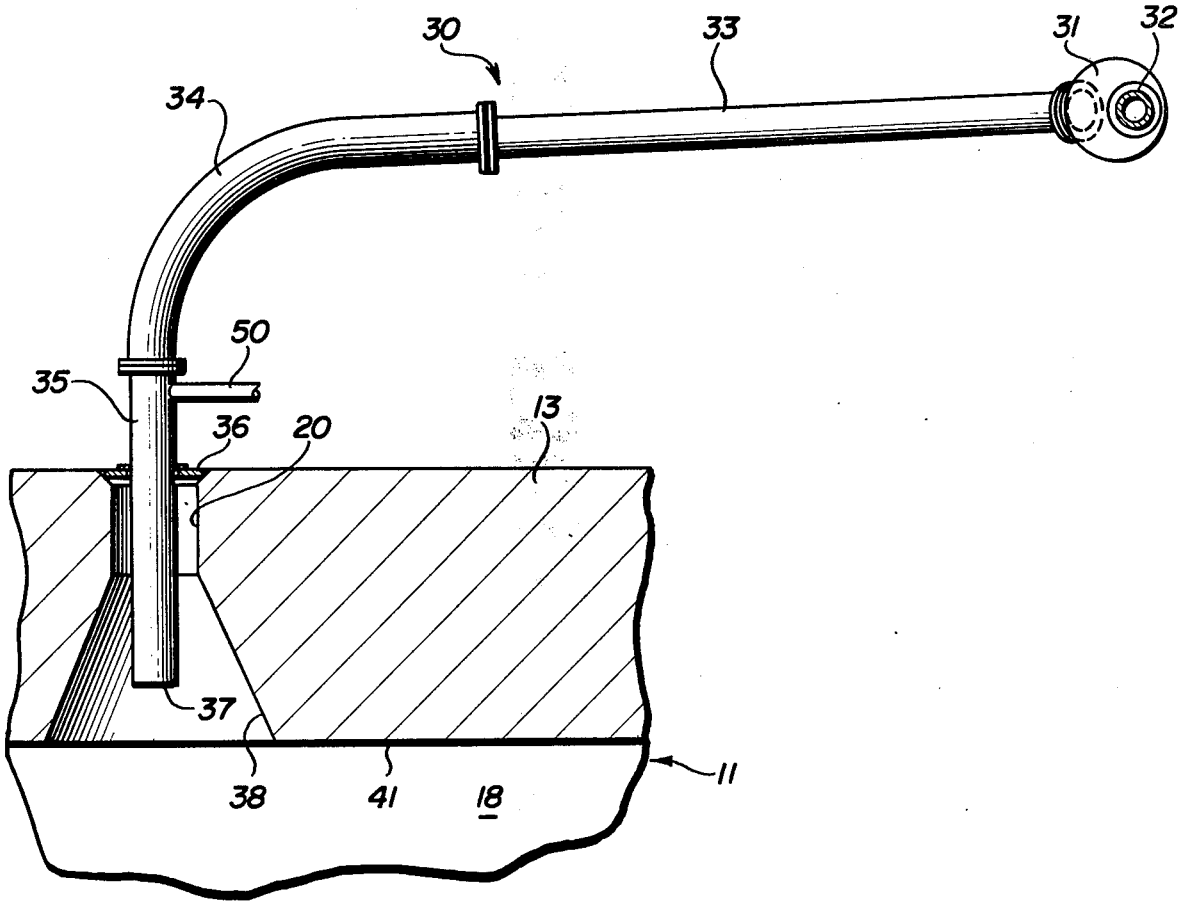
FIG. 3 is an enlarged vertical sectional view illustrating an opening in the top of the coke oven through which coal is charged.

It has been determined that, with top charging, as the location at which the coal is introduced approaches the exhaust outlet, the amount of fines carryover increases; but even when the coal is introduced at a top charging location corresponding to opening 22 in FIG. 2, the amount of carryover is still less than with end charging through the pusher end 14 remote from the exhaust outlet 21.

Generally, the steam flow rate ranges between 1500 and 3000 lbs. per hour while the coal feed rate ranges between 50,000 and 56,000 lbs., in a time period of 9 to 14 minutes (usually 10 to 12 minutes). The temperature of coal-steam mixture as it enters the coke oven is in the range 350°–500° F.

The foregoing detailed description has been given for clearness of understanding only, and no unnecessary limitations should be understood therefrom, as modifications will be obvious to those skilled in the art.

What is claimed is:

1. A method for charging coal into an elongated coke oven in a battery of coke ovens, said coke oven having longitudinally-spaced first and second ends and a gas-exhaust opening adjacent said first end, said method comprising the steps of:

heating a coke oven to a temperature at which coal volatilizes;

transporting coal particles to said coke oven with steam, as a coal-steam mixture, along an enclosed path including a main enclosed path portion serving other coke ovens in said battery and a branch enclosed path portion between said main path portion and said coke oven;

said transporting step comprising injecting steam at spaced intervals along said main enclosed path portion to convey said coal;

charging said coal into said oven;

exhausting gas from said oven, during said coal charging, only through said gas-exhaust opening adjacent said first end, to create a gas stream in said oven moving toward said gas-exhaust opening;

said coal charging step comprising directing all of said coal-steam mixture downwardly as a single stream through the top of said oven, and spacing said downwardly directed mixture from said second end but closer to said second end than to said first end as the mixture enters the oven, to avoid imparting to said coal particles, by said directing step or by rebounding within said oven, a substantial directional component in the direction of movement of said gas stream toward said gas-exhaust opening;

and avoiding the venting of steam from said mixture in said branch enclosed path portion.

2. A method as recited in claim 1 wherein:

said oven is charged with said coal-steam mixture until the top of the coal in said oven is, on the average, about 5–15% below the top of the oven's interior.

3. A method as recited in claim 1 wherein said transporting step comprises:

conveying said coal-steam mixture through said branch path portion along a first path part extending from said main path portion toward said coke oven, then along a second path part curving downwardly from said first path part into a third, vertically depending path part having an axis substantially tangential to the axis of said curved path part;

and preventing condensables in said coal-steam mixture from accumulating in said branch path portion by sloping said first path part toward said coke oven.

4. A method as recited in claim 1 and comprising:

introducing said coal so that it initially accumulates in a relatively dense, localized pile on the coke oven floor directly below the entry location in the oven top of said coal steam mixture, at the beginning of the charging operation, whereby the coal undergoes less volatilization during at least the beginning of the charging operation compared to a charging operation in which the same amount of coal was more widely distributed across the coke oven floor.

5. A method as recited in claim 1 wherein said branch path portion has a terminal end communicating with said coke oven, and a steam line communicates with said branch path portion for introducing steam therein during a coking operation to cool the branch path portion where it communicates with the coke oven, said method comprising:

injecting steam into said branch enclosed path portion, as the coal-steam mixture is directed downwardly into said coke oven, to prevent said steam line from clogging during charging.

6. A method as recited in claim 1 wherein said coal charging step comprises:

directing said coal-steam mixture into said oven with said mixture being spaced from said second end less than 25% and more than 17% of the distance between said ends, as the mixture enters the oven.

7. A method as recited in claim 1 wherein said coal charging step comprises:

directing said coal-steam mixture into said oven with said mixture being spaced from said second end more than 17% of the distance between said ends, as the mixture enters the oven.

8. A method for charging coal into an elongated coke oven in a battery of coke ovens, said coke oven having longitudinally-spaced first and second ends and a gas-exhaust opening adjacent said first end, and said coke oven being preheated to a temperature at which coal volatilizes, said method comprising the steps of:

transporting coal particles to said coke oven with steam, as a coal-steam mixture, along an enclosed path including a main enclosed path portion serving other coke ovens in said battery and a branch enclosed path portion between said main path portion and said coke oven;

injecting steam at spaced intervals along said main enclosed path portion to convey said coal particles;

introducing said coal particles into said coke oven by directing all of said coal-steam mixture from said branch enclosed path portion downwardly as a single stream through the top of said coke oven, without venting steam from said branch enclosed path portion, and at the same time spacing said stream closer to said second end than to said first end but a sufficient distance from said second end to permit formation of a self-leveling coal bed in said coke oven and to avoid imparting to said coal particles, either by said directing step or by rebounding within said coke oven, a substantial directional component toward said first end; and exhausting gas from said coke oven only through said gas-exhaust opening.

* * * * *